US011661787B2

(12) United States Patent
Moyer et al.

(10) Patent No.: US 11,661,787 B2
(45) Date of Patent: May 30, 2023

(54) SAFE AND LOCK DETECTION SYSTEM

(71) Applicant: JVA Partners, Buffalo Grove, IL (US)

(72) Inventors: David Allen Moyer, New Castle, PA (US); Ashok Hirpara, Wayne, IL (US); Jatinkumar Bhatt, Carol Stream, IL (US)

(73) Assignee: JVA Partners, Buffalo Grove, IL (US)

( * ) Notice: Subject to any disclaimer, the term of this patent is extended or adjusted under 35 U.S.C. 154(b) by 561 days.

(21) Appl. No.: 16/832,327

(22) Filed: Mar. 27, 2020

(65) Prior Publication Data

US 2021/0301583 A1 Sep. 30, 2021

(51) Int. Cl.

| | |
|---|---|
| ***E05B 39/00*** | (2006.01) |
| ***E05G 1/10*** | (2006.01) |
| ***E05G 1/04*** | (2006.01) |
| ***E05C 9/04*** | (2006.01) |
| ***G08B 13/08*** | (2006.01) |
| ***E05B 65/00*** | (2006.01) |

(52) U.S. Cl.

CPC ..... *E05G 1/10* (2013.01); *E05B 39/00* (2013.01); *E05B 65/0075* (2013.01); *E05C 9/04* (2013.01); *E05G 1/04* (2013.01); *G08B 13/08* (2013.01); *E05Y 2900/60* (2013.01)

(58) Field of Classification Search

CPC ... E05C 9/06; E05C 9/04; E05B 47/06; E05B 59/00; E05B 65/0075; E05B 39/00; E05B 47/0001; E05B 2047/0068; E05B 2047/0086; E05B 2035/009; E05G 1/04; E05G 1/10; G08B 13/08; E05Y 2400/10; E05Y 2900/60; E05Y 2400/44

USPC ..... 109/43

See application file for complete search history.

(56) References Cited

U.S. PATENT DOCUMENTS

| | | | | |
|---|---|---|---|---|
| 4,944,170 | A | 7/1990 | Jolidon et al. | |
| 5,094,483 | A * | 3/1992 | James | E05B 65/0075 109/59 R |
| 5,196,841 | A | 3/1993 | Harder et al. | |
| 5,245,846 | A * | 9/1993 | James | E05B 65/0078 109/59 R |
| 5,778,708 | A * | 7/1998 | Crosby | E05B 65/0075 292/DIG. 60 |
| 5,911,763 | A * | 6/1999 | Quesada | E05C 9/06 70/108 |
| 6,705,136 | B2 * | 3/2004 | Porter | G07C 9/00182 70/279.1 |
| 7,824,116 | B2 * | 11/2010 | Lyman | B41J 3/4075 400/613 |
| 8,347,665 | B2 * | 1/2013 | Rasmussen | E05B 65/0075 70/91 |
| 9,822,553 | B1 * | 11/2017 | Ho | E05B 47/026 |
| 11,408,213 | B2 * | 8/2022 | Lai | E05C 9/12 |
| 2005/0219037 | A1 | 10/2005 | Huang | |
| 2007/0085655 | A1 | 4/2007 | Wildman et al. | |
| 2014/0167574 | A1 * | 6/2014 | Shoenfeld | A47B 88/994 312/215 |

(Continued)

FOREIGN PATENT DOCUMENTS

| | | |
|---|---|---|
| CN | 201158993 Y | 12/2008 |
| CN | 201221248 Y | 4/2009 |

(Continued)

*Primary Examiner* — Suzanne L Barrett

(74) *Attorney, Agent, or Firm* — Banner & Witcoff, Ltd.

(57) ABSTRACT

Systems and methods to indicate whether a safe is locked or unlocked.

34 Claims, 7 Drawing Sheets

(56) References Cited

U.S. PATENT DOCUMENTS

| | | | | |
|---|---|---|---|---|
| 2015/0332528 | A1 | 11/2015 | McGinnis et al. | |
| 2016/0145904 | A1* | 5/2016 | Lowder | E05B 47/0001 292/145 |
| 2016/0189511 | A1* | 6/2016 | Peterson | E05B 47/06 340/545.3 |
| 2017/0161975 | A1* | 6/2017 | Peng | E05B 47/0012 |
| 2017/0204636 | A1* | 7/2017 | Sack | G07C 9/00309 |
| 2018/0066453 | A1* | 3/2018 | Dobbins | E05B 47/0603 |
| 2018/0108192 | A1* | 4/2018 | Ho | G07C 9/253 |
| 2018/0171671 | A1* | 6/2018 | Martin | E05B 15/1621 |

FOREIGN PATENT DOCUMENTS

| | | | | | |
|---|---|---|---|---|---|
| CN | 102094557 | A | | 6/2011 | |
| CN | 201915752 | U | | 8/2011 | |
| CN | 202831895 | U | | 3/2013 | |
| CN | 203034960 | U | | 7/2013 | |
| CN | 203034961 | U | | 7/2013 | |
| CN | 203034962 | U | | 7/2013 | |
| CN | 204139784 | U | | 2/2015 | |
| CN | 106364408 | A | | 2/2017 | |
| CN | 107060572 | A | * | 8/2017 | C09D 4/06 |
| CN | 208122537 | U | | 11/2018 | |
| CN | 110051148 | A | | 7/2019 | |
| CN | 110107154 | A | | 8/2019 | |
| CN | 111247301 | A | * | 6/2020 | E05B 47/0012 |
| EP | 0111186 | B1 | * | 4/1992 | |
| EP | 3751079 | A1 | * | 12/2020 | E05B 15/0013 |
| TW | M367223 | U | | 10/2009 | |
| WO | 8503971 | A1 | | 9/1985 | |
| WO | 05069910 | A2 | | 8/2005 | |
| WO | WO-2021156497 | A1 | * | 8/2021 | E05B 13/00 |

* cited by examiner

SAFE AND LOCK DETECTION SYSTEM

TECHNICAL FIELD

Aspects of the present disclosure generally relate to safes and locking systems, and particularly to safes and lock detection systems.

BACKGROUND

Safes and other locking containers such as gun safes and vaults and other similar devices may be used to securely store items inside the safe or locking container. Aspects of this disclosure relate to improved safes and locking containers and particularly to safes and locking containers having lock detection systems.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

A lock engagement detection system and method is disclosed. The lock engagement detection system may be configured to indicate or otherwise confirm that a locking mechanism has or has not been engaged such that a locked state or an unlocked state has been achieved. The locking mechanism may be associated with a container such as a safe or other structure such as an entryway into a room, building, or other structure.

In a safe, for example, a locked state may be achieved by extending one or more live action deadbolts and an unlocked state may be achieved by disengaging (e.g., retracting) the live action deadbolts by way of an exterior handle. In some cases, extending the live action deadbolts to a position corresponding to a locked state of the safe causes an interior latch to engage (e.g., extend) which prevents movement (e.g., rotation) of the handle. A user may disengage the latch by providing appropriate access credentials at an exterior user interface (e.g., a keypad). Upon receipt of the appropriate access credentials, a solenoid may disengage (e.g. retract) the latch thereby allowing a user to move the handle and unlock the safe. With the latch disengaged (e.g., retracted), the user may move (e.g., rotate) the handle to disengage (e.g., retract) the live action deadbolts to a position corresponding to an unlocked state of the safe. With the live bolts disengaged, the user may open the door.

A lock engagement sensor may be used to indicate that the safe is in a locked state. The lock engagement sensor may be configured such that it is actuated when the live action deadbolts have been moved to a position corresponding to a locked state of the safe, for example, when the live action deadbolts have been moved to engage the frame of the safe. In order to ensure that the indication of the locked state of the safe is accurate, the lock engagement sensor may be configured such that it is activated after the live action deadbolts have been engaged and/or after the latch is engaged.

It will be appreciated that the disclosures set forth herein are not limited to safes and can be applied to any container, structure, door, and the like in order to indicate whether a locked state or an unlocked state has been achieved.

BRIEF DESCRIPTION OF THE DRAWINGS

The present disclosure is illustrated by way of example and not limited in the accompanying figures in which like reference numerals indicate similar elements and in which.

Figure 1:
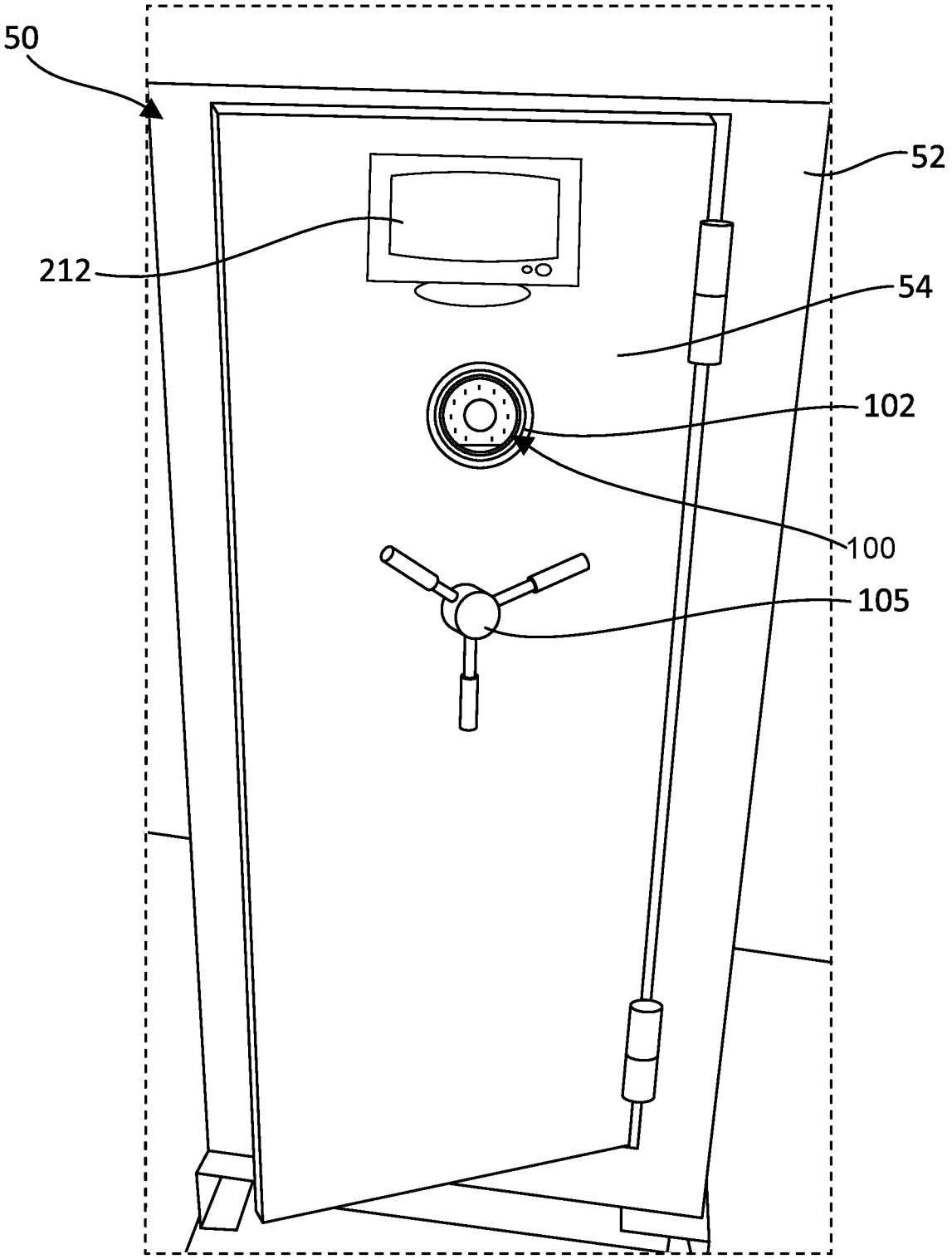
FIG. 1 depicts an isometric view of an example safe, according to one or more aspects described herein.

Further, it is to be understood that the drawings may represent the scale of different components of various examples; however, the disclosed examples are not limited to that particular scale.

DETAILED DESCRIPTION

While the claimed subject matter is susceptible of embodiments in many different forms, there are shown in the drawings and will herein be described in detail exemplary embodiments of the claimed subject matter with the understanding that the present disclosure is to be considered as an exemplification of the principles of the claimed subject matter and is not intended to limit the broad aspects of the claimed subject matter to the embodiments illustrated. It is to be understood that other embodiments may be utilized, and structural and functional modifications may be made, without departing from the scope and spirit of the present disclosure.

In the following description of the various embodiments, reference is made to the accompanying drawings, which form a part hereof, and in which is shown by way of illustration, various embodiments of the disclosure that may be practiced. It is to be understood that other embodiments may be utilized.

In the following description of various example structures according to the claimed subject matter, reference is made to the accompanying drawings, which form a part hereof, and in which are shown by way of illustration various example devices, systems, and environments in which aspects of the claimed subject matter may be practiced. It is to be understood that other specific arrangements of parts, example devices, systems, and environments may be utilized and structural and functional modifications may be made without departing from the scope of the present claimed subject matter claimed subject matter. Also, while the terms "top," "bottom," "front," "back," "side," "rear," "upward," "downward," and the like may be used in this specification to describe various example features and elements of the claimed subject matter, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this claimed subject matter. Also, the reader is advised that the attached drawings are not necessarily drawn to scale.

In general, aspects of this disclosure relate to safes and locking systems and lock detection systems. According to various aspects and embodiments, the safe may be formed of one or more of a variety of materials, such as metals (including metal alloys), plastics, polymers, and composites, and may be formed in one of a variety of configurations, without departing from the scope of the claimed subject matter.

The various figures in this application illustrate examples of safes and locking systems and lock detection systems according to this disclosure. When the same reference number appears in more than one drawing, that reference number is used consistently in this specification and the drawings to refer to the same or similar parts throughout.

FIG. 1 depicts an isometric view of one example of a safe or locking container 50, according to one or more aspects described herein. In particular, the safe 50 includes a container portion 52 and a door portion 54. As shown in FIG. 1 container portion 52 includes sidewalls and at least one opening. The opening is covered by the door portion 54. As shown in FIG. 1, the door 54 can be movably engaged with the container portion 52, and the door 54 is movable (e.g., rotatable about its hinges) between an open position and a closed position.

The safe or locking container 50 also includes a locking system 100. The locking system is engaged with the door 54 and includes portions of the locking system 100 on the inside of the door 54 and on the outside of the door 54. As shown in FIG. 1, the safe 50 includes a user interface 102. The user interface allows a user to lock and to unlock the safe. In some embodiments (and as shown in FIG. 1) the user interface may be an electronic keypad. The electronic keypad, for example, may be the type disclosed in U.S. Pat. No. D618,081 entitled "Electronic Lock" which is incorporated by reference herein in its entirety. In other embodiments, the user interface 102 may be a standard combination type lock, a key lock system, a finger print or face identification system, a key fob or any other system allowing a user to lock or unlock the safe 50. In still other embodiments, the user interface may not be located on the door 54 and instead can be located on another device such as a cellular telephone or computer. Additionally, in some embodiments, the safe 50 can include a manual override system 104. The manual override system 104 may allow a user to unlock the safe 50 without using the user interface 102. For example, in some embodiments the manual override system 104 can be a lock and key system.

The safe 50 also includes a handle 105. The handle 105 is located on an outer portion of the door 54. The handle allows a user to extend (or engage) and retract (or disengage) the live action deadbolts which in turn locks or unlocks the safe 50. When the safe is locked, it may be described as being in a locked state. When the safe is unlocked, it may be described as being in an unlocked state. As will be discussed in greater detail below, the handle 105 can be engaged with the internal components of the safe 50 and particularly is engaged with the movable portion 110.

Figure 2:
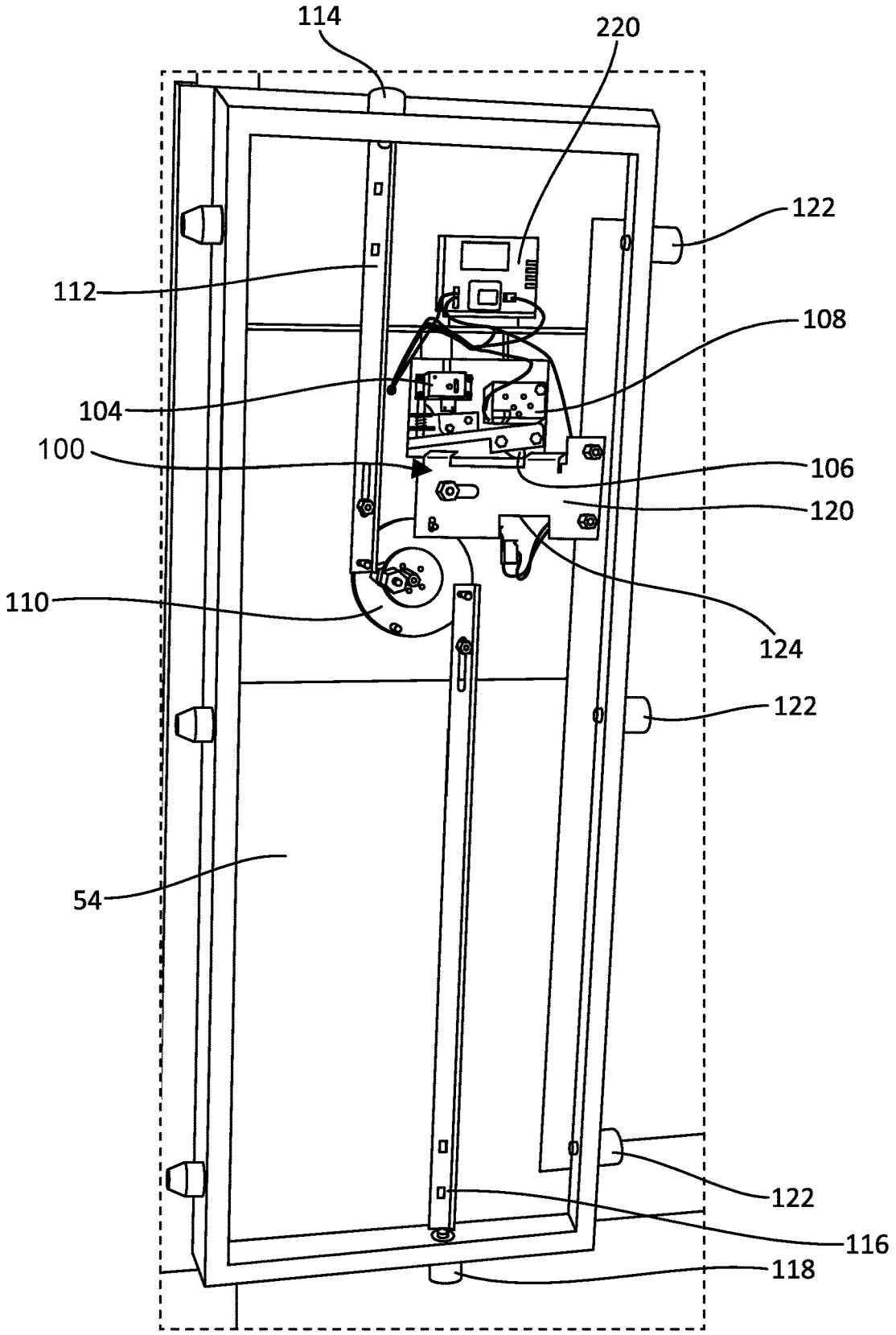
FIG. 2 depicts an isometric inside view of a safe door with an inside panel removed, according to one or more aspects described herein.
Figure 3A:
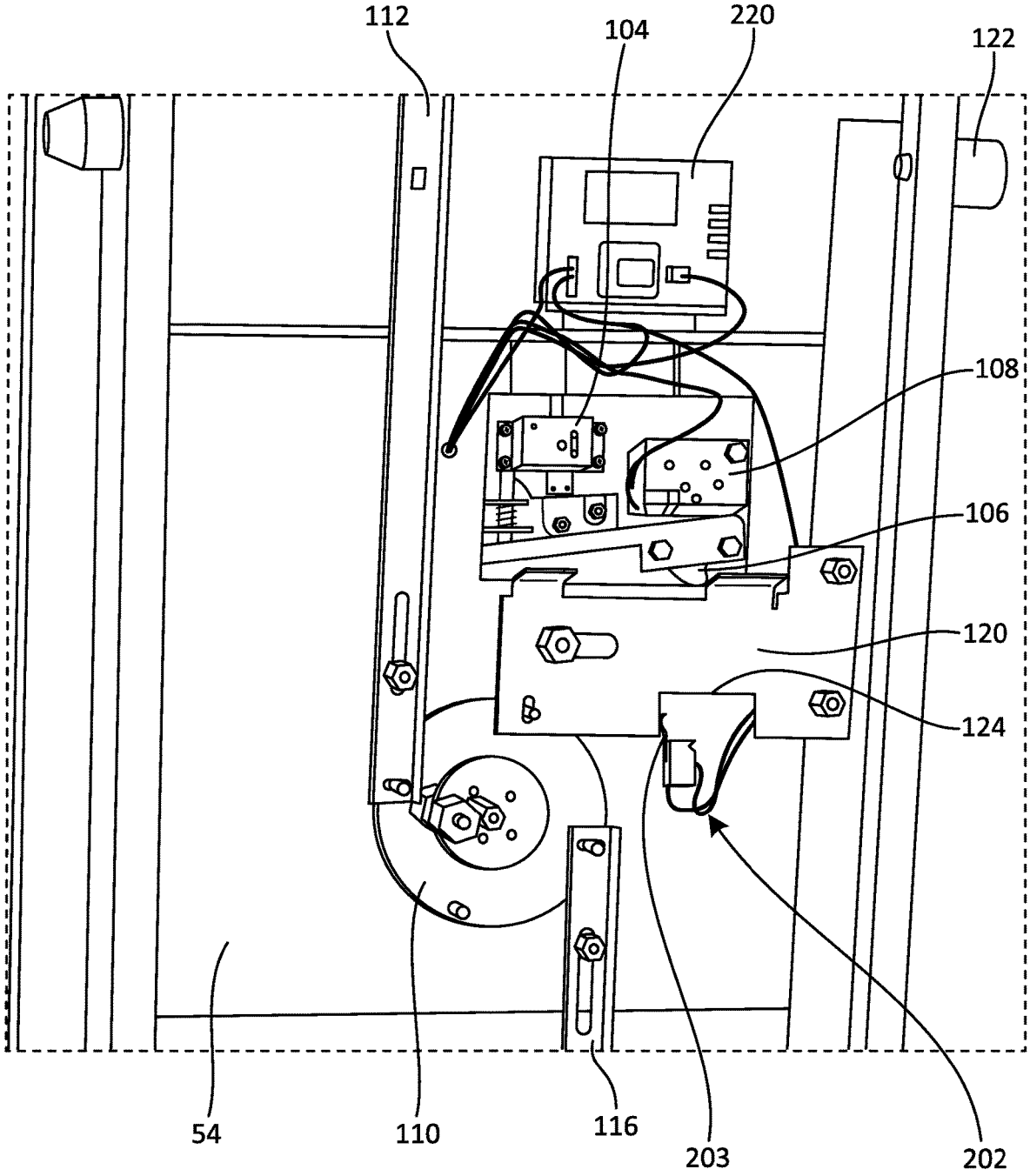
FIG. 3A depicts a detailed portion of the safe door of FIG. 2 with the safe door in a locked position.
Figure 3B:
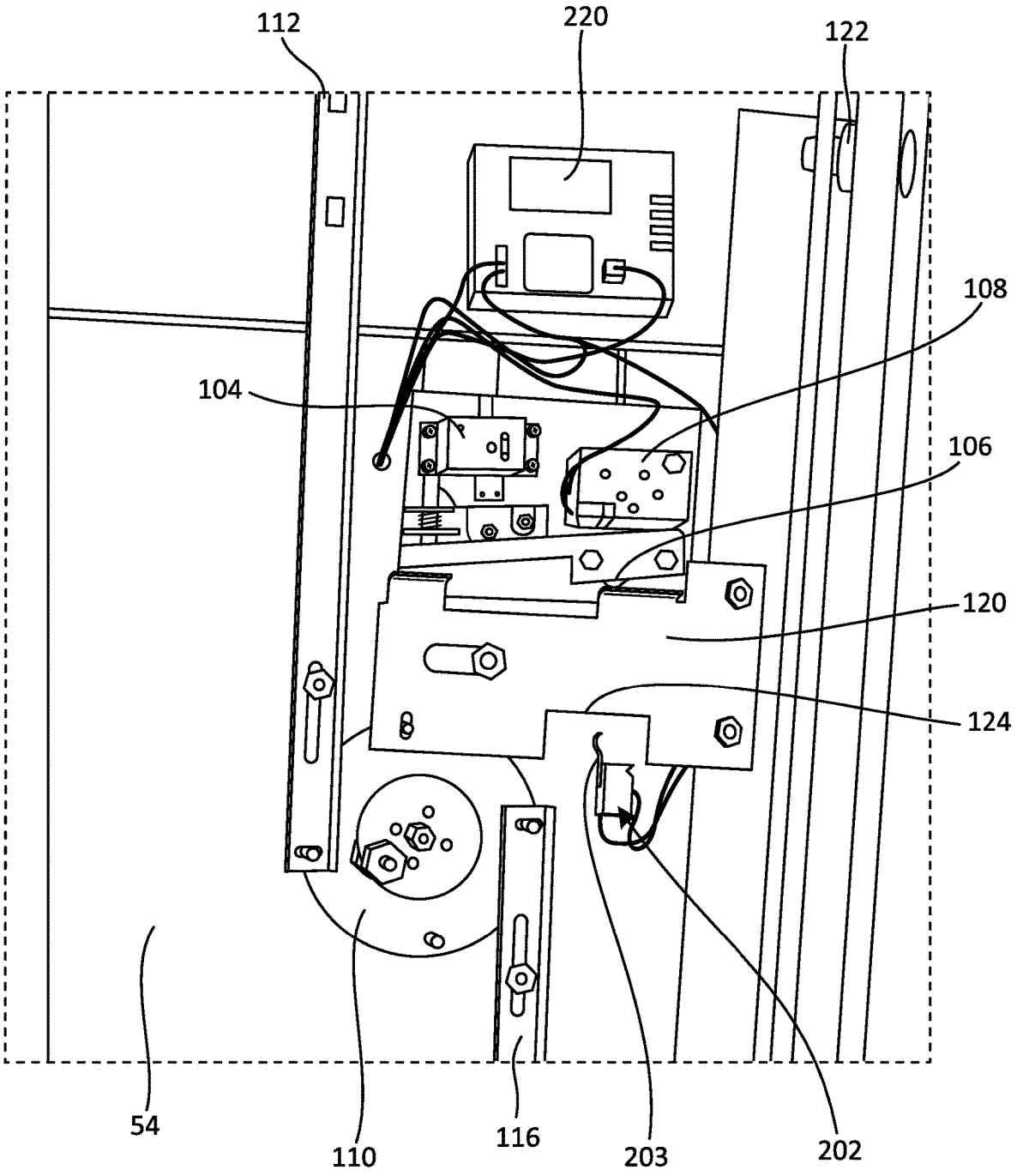
FIG. 3B depicts a detailed portion of the safe door of FIG. 2 with the safe door in an unlocked position.

Referring now primarily to the inside portions of the safe 50 shown in FIGS. 2-3B, the safe 50 may also include a latch 106. The latch 106 may lock the safe 50 and restrict a user from rotating the handle 105. The latch 106 may be extended or retracted using a solenoid 108.

The safe 50 may also include a movable portion 110 engaged with the door. For example, the movable portion 110 may be located within the door 54 as shown in FIG. 2. The movable portion 110 is movable between a first position (e.g., a retracted position) that corresponds to an unlocked state of the safe and a second position (e.g., an extended position) that corresponds to a locked state of the safe. As shown in FIG. 2, for example, the movable portion 110 can be a rotatable wheel portion located within the door 54 that rotates between two rotated positions which respectively correspond to a locked state and an unlocked state of the door. As will be described in greater detail below, the movable portion can move between an extended position wherein the live action deadbolts of the safe are extended and a retracted position wherein the live action deadbolts of the safe are retracted. It will be appreciated that the movable portion, in some instances, may move between the extended position and the retracted position when the door is both open and closed. Accordingly, if the movable portion is in the extended position with the door ajar, it will be recognized that it may be necessary to move the movable portion to the retracted position before the door can be shut. Although the movable portion 110 is shown as a rotatable wheel in FIGS. 2-3B, the movable portion may move in other ways including for example a linearly slidable system. The handle 105 is engaged with the movable portion 110. Thus, typically a rotatable handle 105 will coordinate with the rotatably movable portion 110. Similarly, a linearly slidable movable portion 110 could coordinate with the linearly slidable handle 105. It will be appreciated, however, that any suitable combination of rotatable or linearly slidable handle and rotatable or linearly slidable movable portion may be employed.

As shown in FIG. 2, the safe 50 can include a first vertical engagement member 112 located within the door 54. The first vertical engagement member 112 can be movably (e.g., rotatably) engaged with the movable portion 110. The first vertical engagement member 112 can be configured to move in substantially a vertical direction. The safe 50 can also include a first vertical live action deadbolt 114 engaged with the first vertical engagement member 112. The first vertical live action deadbolt 114. The first vertical live action deadbolt 114 is configured to engage the container portion 52 (FIG. 1) when the movable portion 110 is in the extended position.

As shown in FIG. 2, the safe 50 can include a second vertical engagement member 116 located within the door 54. The second vertical engagement member 116 can be movably (e.g., rotatably) engaged with the movable portion 110. The second vertical engagement member 116 can be configured to move in substantially a vertical direction. The safe 50 can also include a second vertical live action deadbolt 118 engaged with the second vertical engagement member 116. The second vertical live action deadbolt 118. The second vertical live action deadbolt 118 is configured to engage the container portion 52 (FIG. 1) when the movable portion 110 is in the extended position.

As shown in FIG. 2, the safe 50 can also include a lateral engagement bracket 120 located within the door 54. The lateral engagement bracket 120 can be movably (e.g., rotatably) engaged with the movable portion 110. The lateral engagement bracket 120 can be configured to move in substantially a lateral direction. Similar to the movable portion 110, the lateral engagement bracket 120 is movable between a one position corresponding to an unlocked state of the safe (e.g., a retracted position) and another position corresponding to the locked state of the safe (e.g., an extended position). As seen in FIG. 2, rotating the handle 105 (FIG. 1) rotates the movable portion 110 between its retracted and extended positions which causes the lateral engagement bracket 120 to laterally move between its retracted and extended positions. The safe 50 can also include a plurality of lateral live action deadbolts 122 engaged with the lateral engagement bracket 120. The plurality of lateral live action deadbolts 122 are configured to engage the container portion 52 (FIG. 1) when the movable wheel portion 110 and the lateral engagement bracket 120 are respectively in their extended positions.

Figure 4:
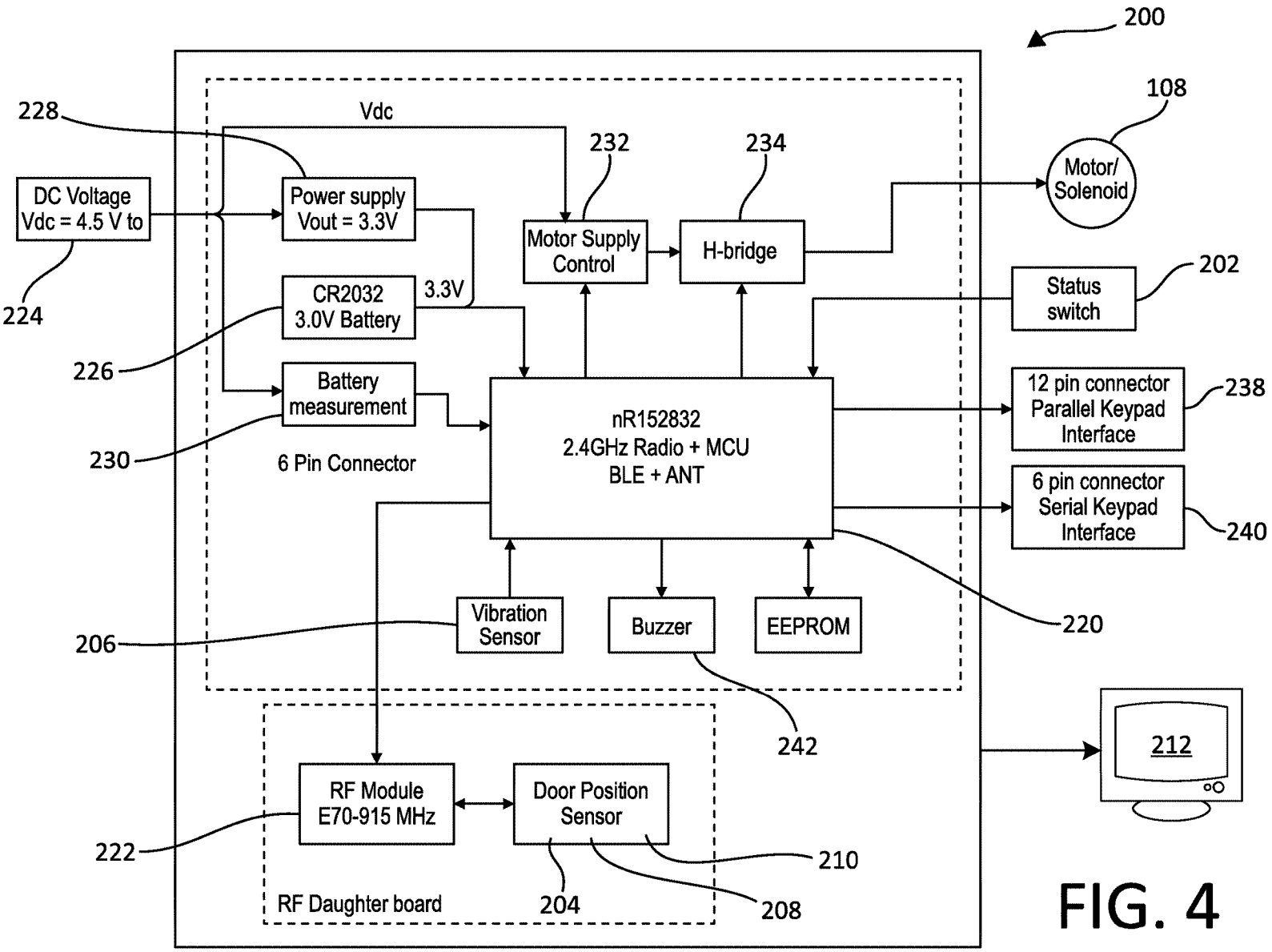
FIG. 4 illustrates a schematic view of elements of an example safe locking system, according to one or more aspects described herein.

Referring now primarily to FIGS. 2 and 4, the safe 50 can also include a lock engagement detection system 200 primarily for detecting whether the door is in an open or closed position and whether the safe is in a locked or unlocked position (or whether the movable portion 110 is in the extended position or the retracted position). The lock engagement detection system 200 can include a number of components. For example, the lock engagement detection system 200 can include a lock engagement sensor 202. The lock engagement sensor 202 can be located within the door 54 as shown in FIG. 2. The lock engagement sensor 202 can be configured to determine whether the movable portion 110 is in the extended position or the retracted position. As shown in FIG. 2, the lock engagement sensor 202 can be a switch type sensor (e.g., a lever switch), however, other types of switches and other types of sensors that can sense or detect movement of the movable portion 110 could be used including, for example, a proximity sensor, a magnetic sensor, an accelerometer, an infrared sensor, a pressure sensor, an ultrasonic sensor, a touch sensor. Additionally, as shown in FIG. 2 the lock engagement sensor 202 can be configured to sense the movement of the movable portion 110 by sensing the movement of portions that are engaged directly or indirectly with the movable portion 110 such as, for example, the lateral engagement bracket 120. As shown in FIG. 2, the lateral engagement bracket includes a notch 124 which contacts the lock engagement sensor 202 when the movable portion 110 and the lateral engagement bracket 120 are respectively in their extended positions. The notch 124, in this example, does not contact the lateral engagement bracket 120 when the movable portion 110 and the lateral engagement bracket 120 are respectively in their retracted positions. In other embodiments the movable portion 110 may include the notch 124 rather than the lateral engagement bracket 120, or the notch could be replaced with a tab or other similar structure that causes the lock engagement sensor 202 to indicate movement, proximity, and/or position of the movable portion 110 and/or the lateral engagement bracket 120. In still other embodiments, a notch, tab, or other suitable structure may be engaged with (e.g., located within) the interior portion of the door, and the lock engagement sensor may be engaged with (e.g., located on) the movable portion 110 or the lateral engagement bracket 120. And in still other embodiments, the engagement sensor 202 can directly sense the movement of the movable portion 110 and/or the lateral engagement bracket 120 by sensing a portion of the movable portion 110 and/or lateral engagement bracket 120. In FIG. 3A, for example, the lock engagement sensor 202 is a lever type switch that includes a lever 203. In FIG. 3A, the movable portion 110 and lateral engagement bracket 120 are in their extended positions which has caused the notch 124 to actuate (e.g., depress) the lever 203 of the lock engagement sensor 202. As also seen in FIG. 3A, the latch 106 is extended thus preventing lateral movement of the lateral engagement bracket 120 thereby fixing the deadbolts 122 in place to lock the safe. With the lever 203 actuated as seen in FIG. 3A, the lock engagement sensor 202 may send a signal to the control unit 220 indicating that the safe is in a locked state. In corresponding FIG. 3B, the movable portion 110 and lateral engagement bracket 120 are in their retracted positions so the lever 203 of the lock engagement sensor 202 is not actuated (e.g., not depressed) by the notch 124. With the lever 203 not actuated in FIG. 3B, the lock engagement sensor 202 may send a signal to the control unit 220 indicating that the safe is in an unlocked state. It will be appreciated that the control unit 220 may additionally or alternatively be configured (e.g., programmed) to determine that the safe is in a locked state or an unlocked state based on the absence of a signal from the lock engagement sensor 202.

The lock engagement detection system 200 can also include a door position detection system 204. The door position detection system 204 can be configured to determine whether the door 54 is in an open position (e.g., ajar) or the closed position, whether the door 54 has moved, and/or a position of the door relative to the container portion (e.g., 0-90°). In some embodiments the door position detection system 204 can include a vibration sensor 206, an accelerometer 208, and a magnetometer 210. However, in other embodiments the door position detection system 204 may include more or fewer sensors to determine whether the door 54 is in the open position or the closed position, whether the door 54 has moved, and/or a position of the door. And like the lock engagement sensor 202, additional sensors can be used including, for example, a proximity sensor, an infrared sensor, a pressure sensor, an ultrasonic sensor, and a touch sensor. The vibration sensor 206 can be configured to determine data related to movement or vibration of the door 54; the accelerometer 208 can be configured to determine data related to movement of the door 54; and the magnetometer 210 can be configured to determine data related to an angular position of the door. Additionally, one or more sensors including the vibration sensor 206 can be configured to sense other conditions of the safe. For example, the vibration sensor can be configured to identify a potential unapproved entry (or entry attempt) to the safe 50 which may identify a burglary situation.

To conserve energy each of the sensors 202, 204, 206 and 208 may typically operate in a hibernation mode. The sensors may exit a hibernation mode once movement is detected by any of the relevant sensor 202, 204, 206, and 208. The sensors 202, 204, 206, and 208 may enter a hibernation mode once no movement is detected by any of the relevant sensors 202, 204, 206, and 208 for a certain preset amount of time, including for example about 1 minute, about 2 minutes, or about 5 minutes. The lock engagement detection system 200 may similarly operate in a hibernation mode in order to account for "play" in the handle that can occur after the movable portion 110 and/or lateral engagement bracket 120 are moved to their respective extended positions and the latch 106 (FIG. 1) has been engaged to lock the safe. Such "play" may include slight movement of the movable portion 110 and/or lateral engagement bracket 120 in a direction away from the extended position. The lock engagement detection system 200 may thus employ a hibernation mode to avoid interpreting one or more signals received from the lock engagement sensor 202 resulting from such "play" as an indication that the movable portion 110 and/or the lateral engagement bracket 120 has moved back to the retracted position. In other words, the lock engagement detection system 200 may employ the hibernation mode to ensure the "play" in the handle does not result in an indication that the safe has been unlocked. This hibernation mode thus ensures that the lock engagement detection system 200 recognizes the safe is locked notwithstanding any "play" in the handle. The hibernation mode may involve neutralizing (e.g., overriding) the lock engagement sensor 202 after it has been engaged by movement of the movable portion 110 or the lateral engagement bracket 120 to the extended position corresponding to the locked state of the safe. Various techniques may be employed to neutralize the lock engagement sensor 202. For example, the lock engagement detection system 200 may be configured (e.g., programmed) to ignore one or more signals received from the lock engagement sensor 202 after the movable portion 110 and/or lateral engagement bracket 120 are moved to their respective extended positions and the latch 106 (FIG. 1) has been engaged to lock the safe and subsequently accept (e.g., recognize, respond to, or the like) signals from the lock engagement sensor 202 only after valid access credentials (e.g., password, PIN, or the like) have been provided. Other techniques may include cutting power to the lock engagement sensor 202, opening a circuit between the lock engagement sensor 202 and the control unit 220 of the lock engagement detection, otherwise block one or more signals from the lock engagement sensor 202, or otherwise prevent the lock engagement sensor 202 from sending one or more signals.

The lock engagement detection system 200 can also include an indicator system 212. The indicator system 212 can be configured to display the status of the safe including at least whether the safe is locked or unlocked (or whether the movable portion is in the extended or retracted position), whether the door 54 is open or closed, and whether the safe has power or is in a low power condition. The indicator system 212 can be a visual system and can be located on an outer portion of the safe 50 so that it may be viewable by a user. The indicator system 212 can also be included on a separate device such as a cellular telephone or computer that is connected to the lock engagement system 200 via a wired connection or a wireless connection including, for example, BlueTooth or Wi-Fi. For example, the separate device may receive the status of the safe as a push notification (e.g., an email, a text message, and the like). In some embodiments, the indicator system can be only an audible system. The lock engagement detection system 200 may be configured to communicate with the separate device (e.g., provide the status of the safe to the separate device, receive messages or commands from the separate device, and the like) using one or more of the networking technologies described in U.S. Pat. No. 9,077,716 entitled "Wireless Device Enabled Locking System," U.S. Pat. No. 9,781,599 entitled "System and Method for Access Control via Mobile Device," U.S. Pat. No. 9,820,152 entitled "Invitations for Facilitating Access to Interconnected Devices," and U.S. Pat. No. 10,529,156 entitled "Access Control Via Selective Direct and Indirect Wireless Communications" each of which are incorporated by reference herein in their entirety. The aforementioned networking technologies may also be used to provide one or more users access to the safe (e.g., provide access credentials) and otherwise manage users' access to the safe.

The lock engagement detection system 200 can include a number of additional components each of which may be connected through circuitry or otherwise connected wirelessly. The lock engagement detection system 200, can also include a control unit 220 for controlling overall operation of the system 200. The control unit 220 may include a processor and corresponding instructions that, when executed, control the operation of the system 200. The control unit 220 can be configured to communicate with the various portions of the lock engagement detection system 200 include the lock engagement sensor 202, the door position detection system 204, and the indicator system 212. Data/information captured by the various sensors 202, 204, 206, and 208 can be received by the control unit 220 and can be processed by means of suitable algorithms based on program code stored in memory. The control unit 220 may be, for example, a multi-protocol system-on-chip (SoC) that supports Bluetooth® Low Energy, ANT, and 2.4 GHz ultra low-power wireless communication standards.

The lock engagement detection system 200 may also include one or more RF modules for communicating between components of the lock engagement detection system 200. As shown in FIG. 4, an RF module 222 may communicate between the control unit 220 and the door position detection system 204. The RF module 222 may be, for example, a sub-1 GHz, ultra-low-power wireless microcontroller platform supporting multiple physical layers and RF standards and having a low power RF transceiver, a dedicated RF controller that handles low-level RF protocol commands, and microcontroller.

The lock engagement detection system 200 can also include a number of components which provide power or otherwise monitor or regulate power to the lock engagement detection system. The lock engagement detection system 200 can be powered by a power source 224. In some embodiments, and as shown in FIG. 4, the power source can be DC voltage which can be supplied by one or more batteries or an AC/DC converter. The lock engagement detection system 200 can also include an on board DC-DC voltage regulator 228 which may convert certain voltage inputs to a desired voltage output including for example 3.3 volts which may be required for certain circuits. The lock engagement detection system 200 may also include one or more batteries 226 which can supply power to the lock engagement detection system 200 if power is not otherwise supplied to the system from the power source 224. The lock engagement detection system 200 may also include a power measurement module 230. The power measurement module 230 can measure the power supplied by the power source 224. The power measurement module 230 can communicate with the indicator system 212 which can provide a low or no power alert to a user through the indicator system 212.

The lock engagement detection system 200 can also include a number of additional components which can include a motor supply control 232, an H-Bridge 234, a motor/solenoid 108, connection ports 238, 240, and a buzzer 242. The motor supply control 232 can control motor supply voltage and can be controlled through the control unit 220. The H-bridge 234 is an electronic circuit that enables a voltage to be applied across a load in opposite direction which can be used to allow DC motors to run forwards or backward or activate the solenoid 236. The motor/solenoid 108 can be connected to the lock engagement detection system 200 and can be controlled through the control unit 220.

The lock engagement detection system 200 can also include one or more connector ports including for example a 12-pin connector port 238 and a 6-pin connector port. These connector ports can be used to interface and communicate with exterior systems and hardware. The lock engagement detection system 200 can also include one or more audible alerts such as buzzer 242. The audible alert 242 can be configured to make an audible sound signifying certain conditions of the safe 50 including for example, that the safe is open or closed, that the safe has a low battery, and that vibration of the safe was detected.

Figure 5:
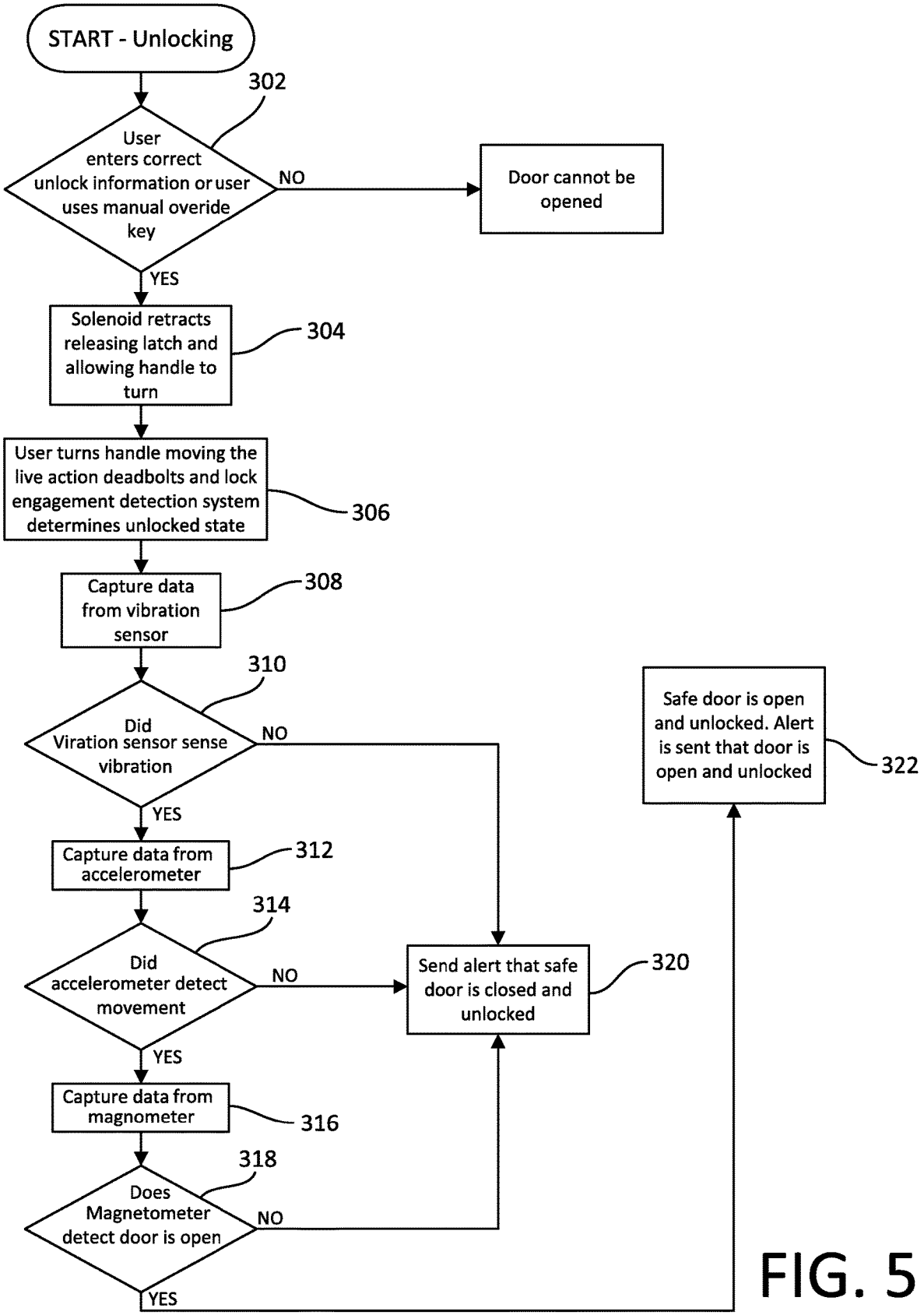
FIG. 5 is a flow chart showing an example method for unlocking a safe, according to one or more aspects described herein.

FIG. 5 illustrates an exemplary method for unlocking a safe 50 having a lock engagement detection system 200 as described herein. A safe 50 can be provided having components discussed above. The method can then start with a user entering information 302 into the user interface 102. If the user enters the correct combination into the user interface 102 it can communicate with the control module 220 and activate the solenoid 108 to release the latch 106 (Step 304). Alternatively a user could use the manual override 118 to release the latch 106. Once the latch 106 is released this allows the user to move the handle 105 in the retracting direction which moves the movable portion 110 in the retracting direction and which removes the live action deadbolts 114, 118, 122 from engagement with the container portion 52 of the safe 50 (e.g., via the lateral movement of the lateral engagement plate 120 toward its retracted position) which also may cause the lock engagement detection system to determine that the safe is in its unlocked state (Step 306).

Once the lock engagement detection system 200 senses that the door is in the unlocked state (e.g., that the live action deadbolts are no longer engaged with the container portion 52 of the safe 50 or that the movable portion 110 is in the retracted position), the door position detection system 204 may detect the position of the door 54. As described above, the door position detection system 204 can comprise a number of sensors including for example a vibration sensor 206, an accelerometer 208, and a magnetometer 210. As shown in FIG. 5 data can be collected from each of these sensors in steps 308, 312, and 316 respectively. This data/information captured by the various sensors 202, 204, 206, and 208 can be received by the control unit 220 and can be processed by means of suitable algorithms based on program code stored in memory. If the door position detection system 204 senses that the door 54 did not move, a signal can be sent by the control unit 220 from the indicator system 212 alerting the user that the safe door 54 is unlocked (or that movable portion 110 is in the retracted position) but the door 54 is still shut. Thus, if the vibration sensor 206 did not sense vibration 312 of the door 54, or if the accelerometer 208 did not sense movement 312 of the door 54, or if the magnetometer 210 did not sense that the door 54 is open 318 a signal can be sent from the indicator system 212 alerting the user that the safe door 54 is unlocked but the door 54 is still shut 320. However, if the sensors 202, 204 206, 208, 210 of the door position detection system 204 detect that the door is open a signal can be sent from the indicator system 212 alerting the user that the safe door 54 is unlocked (or that movable portion 110 is in the retracted position) and the door 54 is open 322.

Figure 6:
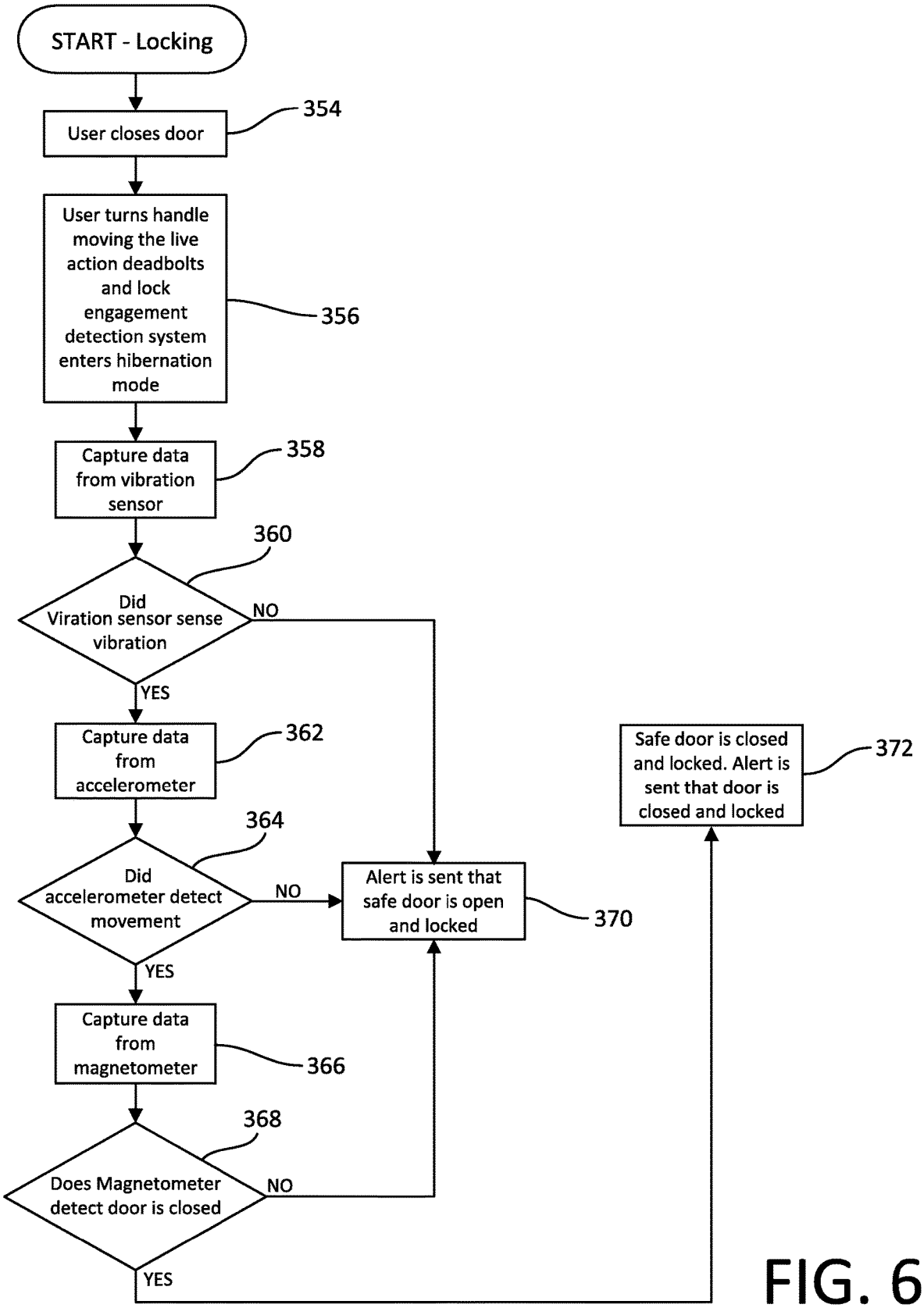
FIG. 6 is a flow chart showing an example method for a locking a safe, according to one or more aspects described herein.

Similarly FIG. 6 illustrates an exemplary process for locking a safe 50 having a lock engagement detection system 200 as described herein. A safe 50 can be provided having components discussed above. The method can then start with a user closing 354 the door 54. Then the user can turn the handle 356 which engages the live action deadbolts with the container portion 52 of the safe 50. Once the lock engagement detection system 200 determines that live action deadbolts are engaged with the container portion 52 of the safe 50 (or that movable portion 110 is in the extended position), the lock engagement detection system 200 may enter a hibernation mode as described above.

Once the lock engagement detection system 200 senses that the door is in the locked state (e.g., that the live action deadbolts are engaged with the container portion 52 of the safe 50 or that movable portion 110 is in the extended position), the door position detection system 204 may detect the position of the door 54. As described above, the door position detection system 204 can comprise a number of sensors including for example a vibration sensor 206, an accelerometer 208, and a magnetometer 210. As shown in FIG. 6, data can be collected from each of these sensors in steps 358, 362, and 366 respectively. Data/information captured by the various sensors 202, 204, 206, and 208 can be received by the control unit 220 and can be processed by means of suitable algorithms based on program code stored in memory. If the door position detection system 204 senses that the door 54 did not move a signal can be sent by the control unit 220 from the indicator system 212 alerting the user that the safe door 54 is locked (or that movable portion 110 is in the extended position) but the door 54 is still open. Thus, if the vibration sensor 206 did not sense vibration 360 of the door 54, or if the accelerometer 208 did not sense movement 364 of the door 54, or if the magnetometer 210 did not sense that the door 54 is closed 368 a signal can be sent from the indicator system 212 alerting the user that the safe door 54 is unlocked but the door 54 is still open 370. However, if the sensors 206, 208, 210 of the door position detection system 204 detect that the door is closed, a signal can be sent from the indicator system 212 alerting the user that the safe door 54 is locked (or that movable portion 110 is in the extended position) and the door 54 is closed 372.

It will be understood by those skilled in the art that the disclosure is not limited to the examples provided above and in the accompanying drawings. Modifications may be made by those skilled in the art, particularly in light of the foregoing teachings. Each of the features of the examples may be utilized alone or in combination or sub-combination with elements of the other examples and/or with other elements. For example, any of the above described methods or parts thereof may be combined with the other methods or parts thereof described above. The steps shown in the figures may be performed in other than the recited order, and one or more steps shown may be optional. It will also be appreciated and understood that modifications may be made without departing from the true spirit and scope of the present disclosure.

What is claimed is:

1. A safe and locking system comprising:

a safe comprising:

a container portion; and a door movably engaged with the container portion, wherein the door is movable between an open position and a closed position:

a locking system engaged with the door, wherein the locking system comprises:

a user interface engaged with an outer portion of the door;

a manual override system;

a handle engaged with an outer portion of the door; and a latch movable between an engaged position and a disengaged position;

a rotatable wheel portion engaged with an interior portion of the door, wherein the rotatable wheel portion is rotatable, based on movement of the handle, between a first rotated position corresponding to an unlocked state of the safe and a second rotated position corresponding to a locked state of the safe;

a first vertical engagement member located within the door and rotatably engaged with the rotatable wheel portion, wherein the first vertical engagement member is configured to move, based on rotation of the rotatable wheel portion, in substantially a vertical direction;

a first vertical live action deadbolt engaged with the first vertical engagement member, wherein the first vertical live action deadbolt is configured to engage the container portion when the rotatable wheel portion is in the second rotated position corresponding to the locked state of the safe;

a second vertical engagement member located within the door and rotatably engaged with the rotatable wheel portion, the second vertical engagement member configured to move, based on rotation of the rotatable wheel portion, in substantially a vertical direction;

a second vertical live action deadbolt engaged with the second vertical engagement member, wherein the second vertical live action deadbolt is configured to engage the container portion when the rotatable wheel portion is in the second rotated position corresponding to the locked state of the safe;

a lateral engagement bracket located within the door and movably engaged with the rotatable wheel portion, wherein the lateral engagement bracket is configured to move, based on rotation of the rotatable wheel portion, and wherein movement of the lateral engagement bracket is restricted when the latch is in the engaged position and unrestricted when the latch is in the disengaged position;

a plurality of lateral live action deadbolts engaged with the lateral engagement bracket, wherein the plurality of lateral live action deadbolts are configured to engage the container portion when the rotatable wheel portion is in the second rotated position corresponding to the locked state of the safe;

a lock engagement detection system comprising:

a lock engagement sensor engaged with the interior portion of the door, wherein the lock engagement sensor is configured to indicate whether the rotatable wheel portion is in the first rotated position corresponding to the unlocked state of the safe or in the second rotated position corresponding to the locked state of the safe, wherein the lock engagement detection system is configured such that the lock engagement sensor is actuated by the lateral engagement bracket after the latch is in the engaged position;

a door position detection system configured to indicate whether the door is in the open position or the closed position, wherein the door position detection system comprises:

a vibration sensor configured to provide first data based on movement of the door;

an accelerometer configured to provide second data based on movement of the door; and a magnetometer configured to provide third data based on an angular position of the door;

an indicator system configured to indicate whether the safe is in the locked state or the unlocked state; and a control unit configured to communicate with the lock engagement sensor, the door position detection system, and the indicator system and configured to send one or more instructions to the indicator system based on data received from at least one of the lock engagement sensor or the door position detection system.

2. The safe and locking system of claim 1, wherein rotatable wheel portion is a gear system.

3. The safe and locking system of claim 1, wherein the rotatable wheel portion is attached to the handle.

4. The safe and locking system of claim 1, wherein the lateral engagement bracket includes a notch and wherein the lock engagement sensor contacts the notch to indicate that the rotatable wheel portion is in the second rotated position corresponding to the locked state of the safe.

5. The safe and locking system of claim 1, wherein the lateral engagement bracket includes a tab and wherein the lock engagement sensor contacts the tab to indicate that the rotatable wheel portion is in the second rotated position corresponding to the locked state of the safe.

6. The safe and locking system of claim 1, further comprising a manual override system that is configured to open the safe without using the user interface.

7. The safe and locking system of claim 6, wherein the manual override system comprises a lock and key system.

8. The safe and locking system of claim 1, wherein the indicator system is further configured to indicate a potential unapproved attempt to enter the safe based on the first data provided by the vibration sensor.

9. The safe and locking system of claim 1, wherein the indicator system is further configured to send an alert based on the control unit determining that the door is in the closed position and that the rotatable wheel is in the second rotated position corresponding to the locked state of the safe.

10. The safe and locking system of claim 1, wherein the indicator system is configured to send an alert based on the control unit determining that the door is in the closed position and that the rotatable wheel portion is in the first rotated position corresponding to the unlocked state of the safe.

11. The safe and locking system of claim 1, wherein the indicator system is configured to send an alert based on the control unit determining that the door is in the open position and that the rotatable wheel portion is in the second rotated position corresponding to the locked state of the safe.

12. The safe and locking system of claim 1, wherein the indicator system is configured to send an alert based on the control unit determining that the door is in the open position and that the rotatable wheel is in the first rotated position corresponding to the unlocked state of the safe.

13. The safe and locking system of claim 1, wherein the lock engagement detection system is configured to enter a hibernation mode based on the control unit determining that the door is in the closed position and that the rotatable wheel is in the second rotated position corresponding to the locked state of the safe.

14. The safe and locking system of claim 1, wherein the lock engagement detection system is configured to exit a hibernation mode based on activation of the user interface or based on the door position detection system detecting movement of the door.

15. A safe and locking system comprising:

a safe comprising:

a container portion; and a door movably engaged with the container portion, wherein the door is movable between an open position and a closed position:

a locking system engaged with the door, wherein the locking system comprises:

a user interface engaged with an outer portion of the door; and a handle engaged with an outer portion of the door;

a movable portion engaged with an interior portion of the door, wherein the movable portion is movable, based on movement of the handle, between a first position corresponding to an unlocked state of the safe and a second position corresponding to a locked state of the safe;

a live action deadbolt engaged with the movable portion, wherein the live action deadbolt is configured to engage the container portion when the movable portion is in the second position corresponding to the locked state of the safe;

a lateral engagement bracket located within the door and movably engaged with the movable portion, wherein the lateral engagement bracket is configured to move, based on rotation of the movable portion;

a lock engagement detection system comprising:

a lock engagement sensor engaged with the interior portion of the door, wherein the lock engagement sensor is configured to indicate whether the movable portion is in the first position corresponding to the unlocked state of the safe or in the second position corresponding to the locked state of the safe, wherein the lock engagement detection system is configured such that the lock engagement sensor is actuated by movement of the lateral engagement bracket;

an indicator system configured to indicate, based on the lock engagement sensor, whether the safe is in the locked state or the unlocked state; and a control unit configured to communicate with the lock engagement sensor and with the indicator system and configured to send one or more instructions to the indicator system based on the lock engagement sensor.

16. The safe and locking system of claim 15, further comprising:

a latch that is movable between an engaged position and a disengaged position, wherein the latch restricts movement of the movable portion when the latch is in the engaged position, and wherein the latch does not restrict movement of the movable portion when the latch is in the disengaged position;

wherein the lock engagement sensor is configured to indicate that the safe is in the locked state after the latch is in the engaged position.

17. The safe and locking system of claim 15, wherein the movable portion is rotatable.

18. The safe and locking system of claim 15, wherein the lock engagement sensor contacts the lateral engagement bracket to indicate that the movable portion is in the second position corresponding to the locked state of the safe.

19. The safe and locking system of claim 15, further comprising an accelerometer configured to provide data based on movement of the door.

20. The safe and locking system of claim 15, further comprising a magnetometer configured provide data based on an angular position of the door.

21. The safe and locking system of claim 15, wherein the indicator system is further configured to send an alert based on the control unit determining that the door is in the closed position and that the movable portion is in the second position corresponding to the locked state of the safe.

22. The safe and locking system of claim 15, wherein the indicator system is configured to send an alert based on the control unit determining that the door is in the closed position and that the movable portion is in the first position corresponding to the unlocked state of the safe.

23. The safe and locking system of claim 15, wherein the indicator system is configured to send an alert based on the control unit determining that the door is in the open position and that the movable portion is in the second position corresponding to the locked state of the safe.

24. The safe and locking system of claim 15, wherein the indicator system is configured to send an alert based on the control unit determining that the door is in the open position and that the movable portion is in the first position corresponding to the unlocked state of the safe.

25. The safe and locking system of claim 15, wherein the lock engagement detection system is configured to enter a hibernation mode based on the control unit determining that the door is in the closed position and that the movable portion is in the second position corresponding to the locked state of the safe.

26. The safe and locking system of claim 15, wherein the lock engagement detection system is configured to exit a hibernation mode based on activation of the user interface or based on the movement of the door.

27. A method for indicating a locked status of a safe, the method comprising:

providing a safe comprising:

a container portion; and a door movably engaged with the container portion, wherein the door is movable between an open position and a closed position:

a locking system engaged with the door, wherein the locking system comprises:

a user interface engaged with an outer portion of the door; and a handle engaged with an outer portion of the door;

a movable portion engaged with an interior portion of the door, wherein the movable portion is movable, based on movement of the handle, between a first position corresponding to an unlocked state of the safe and a second position corresponding to a locked state of the safe;

a live action deadbolt engaged with the movable portion, wherein the live action deadbolt is configured to engage the container portion when the movable portion is in the second position corresponding to a locked state of the safe;

a lateral engagement bracket located within the door and movably engaged with the movable portion, wherein the lateral engagement bracket is configured to move, based on rotation of the movable portion;

a lock engagement detection system comprising:

a lock engagement sensor engaged with the interior portion of the door, wherein the lock engagement sensor is configured to indicate whether the movable portion is in the first position corresponding to the unlocked state of the safe or in the second position corresponding to the locked state of the safe, wherein the lock engagement detection system is configured such that the lock engagement sensor is actuated by movement of the lateral engagement bracket;

an indicator system configured to indicate, based on the lock engagement sensor, whether the safe is in the locked state or the unlocked state; and a control unit configured to communicate with the lock engagement sensor and the indicator system and configured to send one or more instructions to the indicator system based on the lock engagement sensor; and sending, from the indicator system, an alert that indicates whether safe is in the unlocked state or the locked state.

28. The method for indicating a locked status of a safe of claim 27, further comprising sending an alert from the indicator system based on the control unit detecting that the door is in the closed position and that the movable portion is in the second position corresponding to the locked state of the safe.

29. The method for indicating a locked status of a safe of claim 27, further comprising sending an alert from the indicator system based on the control unit detecting that the door is in the closed position and that the movable portion is in the first position corresponding to the unlocked state of the safe.

30. The method for indicating a locked status of a safe of claim 27, further comprising sending an alert from the indicator system based on the control unit detecting that the door is in the open position and that the movable portion is in the second position corresponding to the locked state of the safe.

31. The method for indicating a locked status of a safe of claim 27, further comprising sending an alert from the indicator system based on the control unit detecting that the door is in the open position and that the movable portion is in the first position corresponding to the unlocked state of the safe.

32. The method for indicating a locked status of a safe of claim 27, wherein:

the locking system further comprises a latch that is movable between an engaged position and a disengaged position;

the latch restricts movement of the movable portion when the latch is in the engaged position, and wherein the latch does not restrict movement of the movable portion when the latch is in the disengaged position; and the lock engagement sensor is configured to indicate that the safe is in the locked state after the latch is in the engaged position.

33. The method for indicating a locked status of a safe of claim 27, further comprising causing the lock engagement detection system to enter a hibernation mode based on the control unit determining that the door is in the closed position and that the movable portion is in the second position corresponding to the locked state of the safe.

34. The method for indicating a locked status of a safe of claim 27, further comprising causing the lock engagement detection system to exit a hibernation mode based on activation of the user interface or based on movement of the door.

* * * * *